US005248247A

United States Patent [19]

Rübhausen et al.

[11] Patent Number: 5,248,247

[45] Date of Patent: Sep. 28, 1993

[54] APPARATUS FOR BLOW-EXTRUDING FILAMENTS FOR MAKING A FLEECE

[75] Inventors: Anton Rübhausen, Niederkassel; Daniel Roock, Troisdorf-Spich, both of Fed. Rep. of Germany

[73] Assignee: Reifenhauser GmbH & Co. Maschinenfabrik, Troisdorf, Fed. Rep. of Germany

[21] Appl. No.: 792,254

[22] Filed: Nov. 14, 1991

[30] Foreign Application Priority Data

Nov. 17, 1990 [DE] Fed. Rep. of Germany ..... 4036734

[51] Int. Cl.[5] ..... D01D 5/08

[52] U.S. Cl. ..... 425/66; 264/518; 425/72.2

[58] Field of Search ..... 264/518, 555, 12, 210.8, 264/211.12, 211.14, 211.17; 425/7, 66, 72.1, 72.2, 80.1, 378.2, 382.2, 382.4, 461, 464

[56] References Cited

U.S. PATENT DOCUMENTS 3,802,817 4/1974 Matsuki et al. ..... 425/66
3,970,417 7/1976 Page ..... 425/72.2
4,064,605 12/1977 Akiyama et al. ..... 425/66
5,080,569 1/1992 Gubernick et al. ..... 425/72.2

FOREIGN PATENT DOCUMENTS 0377926 7/1990 European Pat. Off. .

*Primary Examiner*—Jill L. Heitbrink
*Attorney, Agent, or Firm*—Herbert Dubno; Andrew Wilford

[57] ABSTRACT

In a apparatus of making a nonwoven mat wherein a multiplicity of filaments are extruded in a row and a pair of jets of compressed gas are played symmetrically from nozzles upon the filaments as same are extruded to stretch the filaments and deposit same on a substrate the compressed gas is made to flow from a source along respective paths to the nozzles and each of the flows and paths is branched upstream of respective flow-equalizing stations. The speed of the respective flows is decreased and their pressures are increased with at least one diffuser. The flows are then baffled and united between the flow-equalizing station and the respective nozzles in a flow guide.

4 Claims, 2 Drawing Sheets

APPARATUS FOR BLOW-EXTRUDING FILAMENTS FOR MAKING A FLEECE

FIELD OF THE INVENTION

The present invention relates to the extrusion of filaments for making a fleece. More particularly this invention concerns a method of and apparatus for blow-extruding filaments that can be used to make a nonwoven fleece or the like.

BACKGROUND OF THE INVENTION

In order to make a fleece of extrudable synthetic-resin filaments it is standard to plastify the resin and extrude it through a row of tiny holes in a die as individual filaments. The row of holes is flanked by two slot nozzles that emit jets of pressurized air that meet at an acute angle on a line normally directly below the holes. Thus the filaments that exit will be buffeted by these air blasts and will therefore be broken up and deposited below the apparatus on a substrate, normally a moving belt, in a random mass that cures to form a nonwoven mat or fleece.

The way the air jets interact with the emerging monofilaments determines many of the qualities of the fleece. If the filaments are broken up into small pieces, the fleece will be fairly dense, and if they are not broken up at all but instead the air blasts merely cure and harden them so they deposit as endless monofilaments, a looser and spongier fleece will be the result.

In European patent application 377,926 of P. G. Buehning a system of the above-identified type is shown where the compressed air is fed via inlet passages to chambers that open directly at the slit nozzles. The chambers have a larger flow cross section than the sum of the flow cross sections of the nozzles but are not set up as diffusers. Even though some form of flow diverter is provided in the inlet passage upstream of each chamber, there is some variation in pressure along the length of the slit nozzles.

The pressure must not vary even a very small amount along the length of the slit nozzle to produce a uniform product. Indeed, the major factor affecting the product is in fact the air blast on the emerging filaments so that any slight variation will produce a different type of filament and, hence, a strip of different consistency along the nonwoven product that is invariably drawn away in a direction perpendicular to the row of filament-emitting nozzles.

OBJECTS OF THE INVENTION

It is therefore an object of the present invention to provide an improved system for making a nonwoven fleece.

Another object is the provision of such an improved system for making a nonwoven fleece which overcomes the above-given disadvantages, that is which produces a perfectly uniform product.

SUMMARY OF THE INVENTION

The instant invention is an improvement on a method of making a nonwoven mat wherein a multiplicity of filaments are extruded in a row and a pair of jets of compressed gas are played symmetrically from nozzles upon the filaments as same are extruded to stretch the filaments and deposit same on a substrate. According to the invention the compressed gas is made to flow from a source along respective paths to the nozzles and each of the flows and paths is branched upstream of respective flow-equalizing stations. The speeds of the respective flows are decreased and their pressures are increased with at least one diffuser. The flows are each then baffled and united between the flow-equalizing station and the respective nozzles in a flow guide.

The invention is based on the surprising discovery that in the above-described method of making a nonwoven or nonknitted fleece or mat of thermoplastic filaments the blowing air must be perfectly uniformly applied along the entire lengths of the slit nozzles. The system of this invention produces the desired perfectly even pressure to make a product that is perfectly uniform along the full length of the row of nozzles, even at the very end of the row.

Flow guides produce little back pressure and can thus be distinguished from cross vanes of the type in the above-cited patent reference. A diffuser, as is known in aerodynamics, is a device which slows flow speed and increases pressure. Below ultrasonic speeds a diffuser is a region of increasing flow cross section. In order to avoid that the flow breaks up in the diffuser, its flare angle is generally kept to less than 8°. According to the invention, however, the flare angle can be somewhat greater than this limit without deleteriously affecting performance. Thus the air leaves the diffuser or the diffusers with homogenous isotropic turbulence even with decreasing turbulence clusters. The flow evener increases the uniformity of flow.

In any case the invention produces in the flat streams produced by the blow nozzles a very uniform structure without significant speed differences or flow anisotropies. Flow is defined as starting at a uniformity of 100 when over time on every location the flow is of identical structure while at 0 when nothing stays the same. According to the invention the flow is at about 100 over the entire lengths of the slit nozzles, in particular when the flow is particularly turbulent in the branch passages and even enters the diffuser or diffusers with some turbulence.

In accordance with further features of this invention the flows between the flow-equalizing station and the respective nozzles are evened. In addition the branched flows are passed in the station through respective diffusers. These branched flows are evened between the flow-equalizing station and the respective nozzles. Turbulence is imparted to the flows prior to branching.

The apparatus of this invention has an extruder, nozzles, a supply, one or more diffusers, and a flow guide. The flow-equalizing stations are normally provided with separate diffusers for each of the branches. In addition a respective flow evener is provided between each station and the respective nozzle for evening flow therebetween. The flow-equalizing stations are provided with separate flow guides for each flow branch and each of the flows is united immediately upstream of the respective nozzle. The supply system includes respective manifolds extending along respective axes and the branches extend radially from the respective manifolds. This supply system has means for imparting turbulence to the flows. More particularly it has respective manifolds each constituted as an inner tube with outlets opening radially opposite to the respective branches and an outer tube surrounding the inner tube. The compressed gas is supplied under pressure between the tubes.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
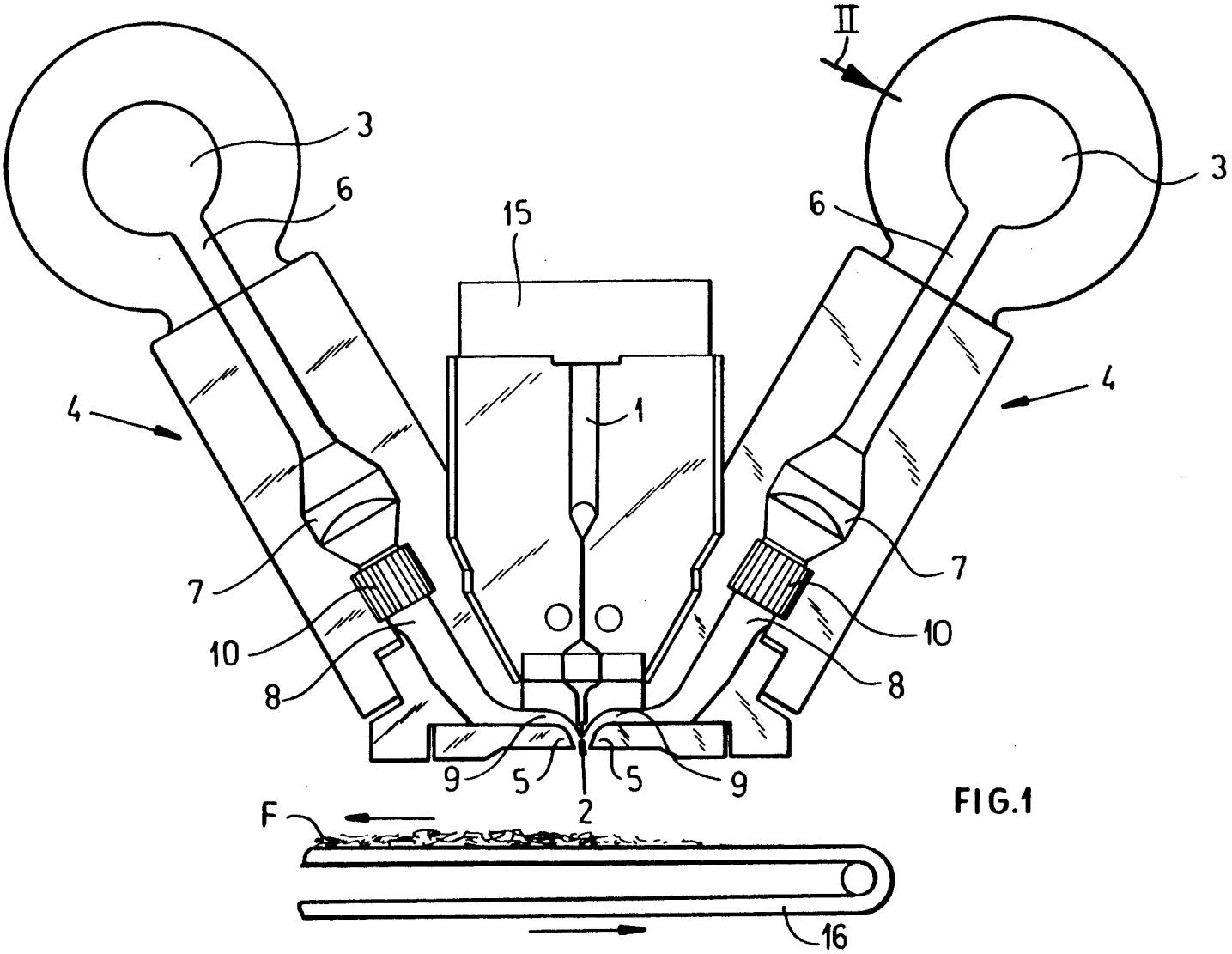
FIG. 1 is an end view partly in section through a system according to the invention.

As seen in FIG. 1 an extruder 15 has a passage 1 ending in a row of holes 2 to emit filaments F that are deposited on a substrate 16 here formed by a belt whose upper stretch moves continuously in a horizontal direction perpendicular to the row of holes 2. To each side of the row of holes 2 is a respective manifold 3 connected via a flow guide arrangement 4 to a slit nozzle 5. The two slit nozzles 5 extend parallel to the row of holes 2 and at the same acute angle to the normally vertical direction the filaments F move in as they descend from the holes 2 to the substrate 16. At least one of the lips defining each of the nozzle slits 5 can be movable to adjust the flow cross section of the respective nozzle slit.

Parallel circular-section branch passages 6 extend downward at an angle from the manifolds 3, leading to one or more diffusers 7 which as shown here are regions of increased flow cross section. The downstream side of the diffuser 7 is restricted and connected via a honeycomb- or mesh-type flow evener 10 to an output passage 8 which extends in a straight line with the respective input passage 6 and which itself is restricted and opens into a restricted-section slot 9 from which the respective slit nozzle 5 opens. Flow control systems such as valves or the like can be provided in the branch passages 6.

Figure 2:
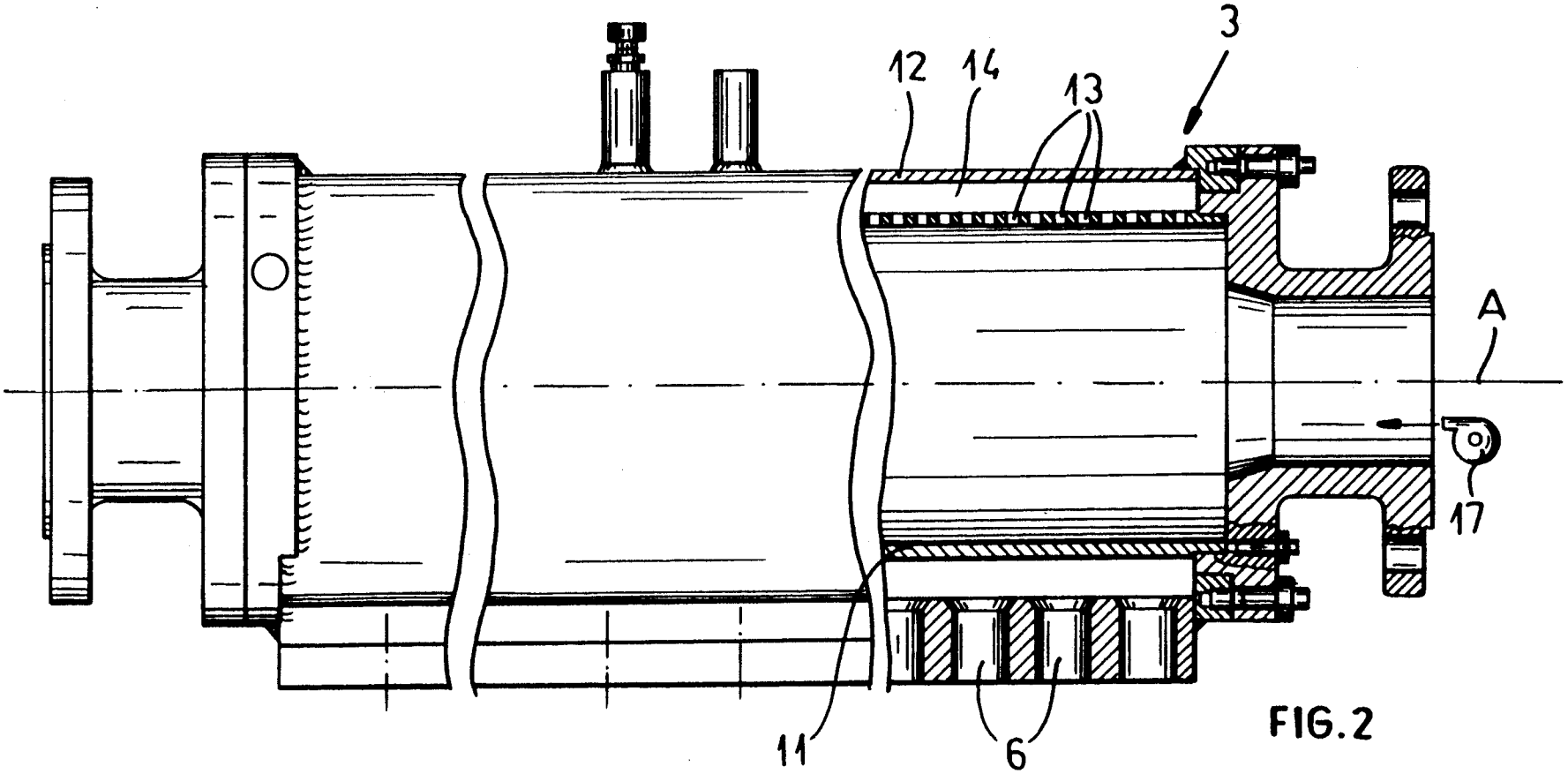
FIG. 2 is a partly sectional detail view taken in the direction of arrow II of FIG. 1.

In the illustrated embodiment as best seen in FIG. 2 each manifold 3 is a distributor formed as a cylindrical inner tube 11 centered on an axis A and formed along one side with an axially extending row of throughgoing holes 13. An outer tube 12 surrounds the tube 11 and forms a space 14 therewith. The branch passages 6 open radially from the space 14 in a direction diametrically opposite the holes 13. A compressor 17 or the like feeds air under pressure into the interior of the inner pipe 11 so that it moves radially out through the holes 13 into the space 14 and then passes around the inner tube 11 to the branch passages 6. This reversal creates considerable turbulence in the air flow.

We claim:

1. An apparatus for making a nonwoven mat, the apparatus comprising:
   - extruder means for emitting a multiplicity of filaments in a row;
   - a pair of slit nozzles directed symmetrically upon the filaments as same are extruded;
   - structure forming for each slit nozzle a row of branch passages each having an upstream end and a downstream end, a flow-equalizing station at the downstream end of each branch passage, an output passage having an upstream end opening into each flow-equalizing station and a downstream end, and a flow guide into which the downstream ends of the respective output passages open and extending along and opening into the respective slit nozzle;
   - supply means for flowing a compressed gas from a source into the upstream ends of the branch passages;
   - means including respective diffusers at the stations for decreasing speed and increasing pressure of the flows in the respective flow-equalizing station;
   - respective flow eveners in each station between each diffuser and the respective output passage for evening the respective flows; and
   - means at each flow guide for uniting the respective flows and feeding same to the respective slit nozzles.

2. The mat-making apparatus defined in claim 1 wherein the supply means includes respective manifolds extending along respective axes, the branch passages extending radially from the respective manifolds.

3. The mat-making apparatus defined in claim 1 wherein the supply means includes means for imparting turbulence to the flows.

4. The mat-making apparatus defined in claim 1 wherein the supply means includes respective manifolds each constituted as an inner tube with outlets opening radially opposite to the respective branch passages and an outer tube surrounding the inner tube, the compressed gas being supplied under pressure to an interior of the inner tube.

* * * * *